US011280224B2

(12) United States Patent
Shaw et al.

(10) Patent No.: US 11,280,224 B2
(45) Date of Patent: Mar. 22, 2022

(54) PRE-BOOSTER PUMPING SYSTEM FOR INCREASING POWER GENERATION OF TURBINE OF THERMAL POWER PLANT

(71) Applicants: Raymond Zhou Shaw, Salisbury, MD (US); Bin Wu, Qingpu District (CN); Xiaoqing Pan, Pudong New District (CN)

(72) Inventors: Raymond Zhou Shaw, Salisbury, MD (US); Bin Wu, Qingpu District (CN); Xiaoqing Pan, Pudong New District (CN)

(73) Assignees: ELIVAC COMPANY, LTD., Shanghai (CN); Raymond Zhou Shaw, Shanghai (CN); ELIVAC INC, Salisbury, MD (US)

( * ) Notice: Subject to any disclaimer, the term of this patent is extended or adjusted under 35 U.S.C. 154(b) by 134 days.

(21) Appl. No.: 16/828,955

(22) Filed: Mar. 25, 2020

(65) Prior Publication Data

US 2021/0301683 A1 Sep. 30, 2021

(51) Int. Cl.

| | |
|---|---|
| ***F01K 9/00*** | (2006.01) |
| ***F28B 9/06*** | (2006.01) |
| *F01K 7/38* | (2006.01) |
| *F01K 11/02* | (2006.01) |
| *F28B 1/02* | (2006.01) |
| *F28B 7/00* | (2006.01) |

(52) U.S. Cl.

CPC ..... *F01K 9/003* (2013.01); *F28B 9/06* (2013.01); *F01K 7/38* (2013.01); *F01K 11/02* (2013.01); *F28B 1/02* (2013.01); *F28B 7/00* (2013.01)

(58) Field of Classification Search

CPC . F01K 9/003; F01K 7/38; F01K 11/02; F28B 9/06; F28B 1/02; F28B 7/00

See application file for complete search history.

(56) References Cited

U.S. PATENT DOCUMENTS 6,533,026 B1 * 3/2003 Noah ..... F25B 13/00 165/48.2
10,422,141 B1 * 9/2019 Harkins ..... E04B 1/7675

* cited by examiner

*Primary Examiner* — Shafiq Mian

(57) ABSTRACT

A pre-booster pumping system for increasing power generation of a turbine of a thermal power plant includes a booster pump system including an inlet end, an output end and at least one booster pump; the inlet end of the booster pump system being connected to the air draining end of the turbine through an input tube; each booster pump including an air inlet and an air outlet; the waste gas drained from the air draining end of the turbine being inputted to the booster pump; the vapor pressure being increased in the booster pump and then the vapor being outputted from the output end; and a condenser having an input end; the output end of the booster pump system being connected to the condenser through the output tube; the condenser serving to receive the waste gas from the booster pump system and cool the waste vapor as water.

14 Claims, 7 Drawing Sheets

PRE-BOOSTER PUMPING SYSTEM FOR INCREASING POWER GENERATION OF TURBINE OF THERMAL POWER PLANT

FIELD OF THE INVENTION

The present invention is related to pressure enhancement systems, and in particular to a pre-booster pumping system for increasing power generation of a turbine of a thermal power plant.

BACKGROUND OF THE INVENTION

A turbine is a core element for a thermal power plant. The turbine serves to convert thermal power into mechanic power for power generation. In general, the gas drainage side of a turbine is arranged with a condenser. The condenser other than condenses the vapor from the turbine into water for being used by boilers, but it also forms vacuum in the gas drainage place of the turbine. Pipe lines are arranged for connecting the turbine and the condenser. The vacuum of the condenser will affect the power efficiency of the power generator. This is because the pressure vapor will become waste gas (containing vapor) after driving the turbine. The vacuum of the condenser will affect removing efficiency of the waste gas and the efficiency of the turbine work and thus it affects power generation of the power plant.

Currently, the waste gas (vapor) from the turbine is naturally transferred to the condenser by the pressure difference between. Generally, the pressure of the condenser is reduced so that waste gas can flow into the condenser quickly. For some large scale power generators, in some range, if the vacuum is increased 1 KPa, the coal consumption for each Kilowatt-hour is reduced with a value of 3 grams.

Thermal power plants use water as cooling medium, which is derived from natural sources, such as water from rivers, lakes, sea, air, etc. Due to different seasons, the water temperature is affected by the temperatures of air and water. As a result the vacuum of a condenser cannot be retained in the value of original design. That is to say, in most time, the vacuum of the condenser is not the one which is beneficial to decrease the coal consumption of the power generation of the power plant.

In general, a rear end of the condenser is added with a vacuum pumping system, generally the vacuum pumps are large water circulation pumps or the pumps of other form, some are vapor pumping systems, or water jetting pumps. Thus the pumping system serves to form vacuum in the condenser, but the time period is short, generally not over 2 hours. That is to say, it serves to pump non-condensed gas in the condenser. The pumping amount of these pumps may be enlarged. However, this operation cannot effectively increase the vacuum of the condenser due to the amount of vapor in the water gas is very large and the vapor will evaporate with a higher speed in low pressure.

Therefore, the object of the present invention is to provide a novel system which provide a pressure increasing system in front of the condenser so as to promote the power generation efficiency of a turbine in a thermal power plant for resolving above said defect in the prior art.

SUMMARY OF THE INVENTION

Accordingly, for improving above mentioned defects in the prior art, the object of the present invention is to provide a pre-booster pumping system for increasing power generation of a turbine of a thermal power plant, wherein the booster pump system are added between the turbine and the condenser. The booster pump system serves to pump wasted gas in the turbine so that the drainage of the gas is enforced instead of naturally draining. The waste gas in the turbine is drained with a high efficiency so that power generation of the power system is promoted. Furthermore the coal consumption of the turbine is recued. As a result the power generation of a power plant is not affected by the environmental temperature, destroy of vacuum, and sizes of vacuum pumps. The power generator may be operated in an optimum state. In the present invention, the booster pumps may be connected serially or in parallel as desired so as to have an optimum removing of the waste gas from the turbine.

To achieve above object, the present invention provides a pre-booster pumping system for increasing power generation of a turbine of a thermal power plant, wherein the turbine has an air draining end; if pressured vapor passes through and driving the turbine, the vapor will lose of dynamics so as to form as waste gas (containing air and vapor) which is drained through the air draining end; the pre-booster pumping system comprising: a booster pump system including an inlet end, an output end and at least one booster pump between the inlet end and the output end; the inlet end of the booster pump system being connected to the air draining end of the turbine through an input tube; each booster pump including an air inlet and an air outlet; the waste gas drained from the air draining end of the turbine being inputted to the booster pump from the inlet end of the booster pump; the vapor pressure being increased in the booster pump and then the vapor being outputted from the output end; and a condenser having an input end; the output end of the booster pump system being connected to the input end of the condenser through the output tube; the condenser serving to receive the waste gas (containing air and vapor) from the booster pump system and cool the waste vapor as water.

DETAILED DESCRIPTION OF THE INVENTION

Figure 1:
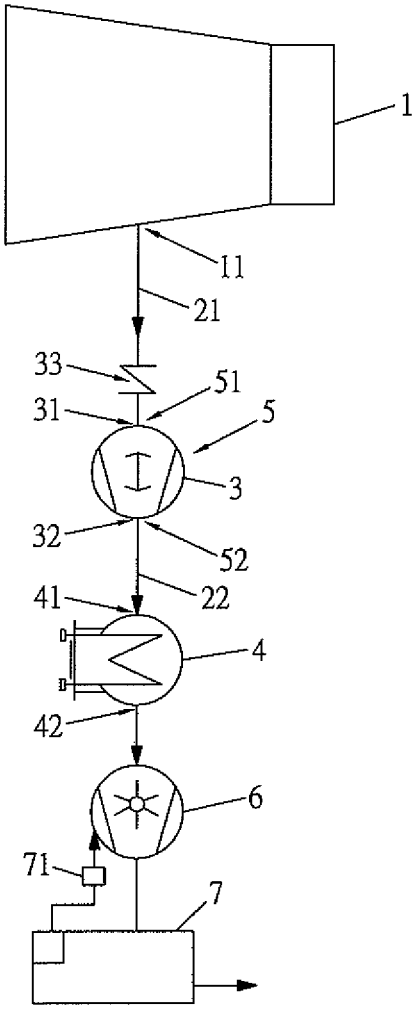
FIG. 1 is an assembly schematic view showing the element arrangement of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 9, the system of the present invention includes the following elements.

A turbine 1 has an air draining end 11. If pressured vapor passes through and driving the turbine 1, the vapor will lose of dynamics so as to form as waste gas (containing air and vapor) which is drained through the air draining end 11. Generally, the turbine 1 is used in a thermal power plant and has power from vapor. The turbine 1 converts thermal energy of the vapor into mechanical works for driving the power generator of the power plant.

A booster pump system 5 includes an inlet end 51, an output end 52 and at least one booster pump 3 between the inlet end 51 and the output end 52. The inlet end 51 of the booster pump system 5 is connected to the air draining end 11 of the turbine 1 through an input tube 21. Each booster pump 3 includes an air inlet 31 and an air outlet 32. The waste gas drained from the air draining end 11 of the turbine 1 is inputted to the booster pump 3 from the inlet end 51 of the booster pump 3. The vapor pressure is increased in the booster pump 3 and then the vapor is outputted from the output end 52. The booster pump 3 may be one of root pumps, centrifugal pumps, jet pumps or air pumps which can pump a large amount of air and can increase air transfer speed therein. Therefore, by the at least one booster pump 3, the waste gas in the turbine 1 may be pumped out so that gas in the turbine 1 is drained enforce.

Figure 2:
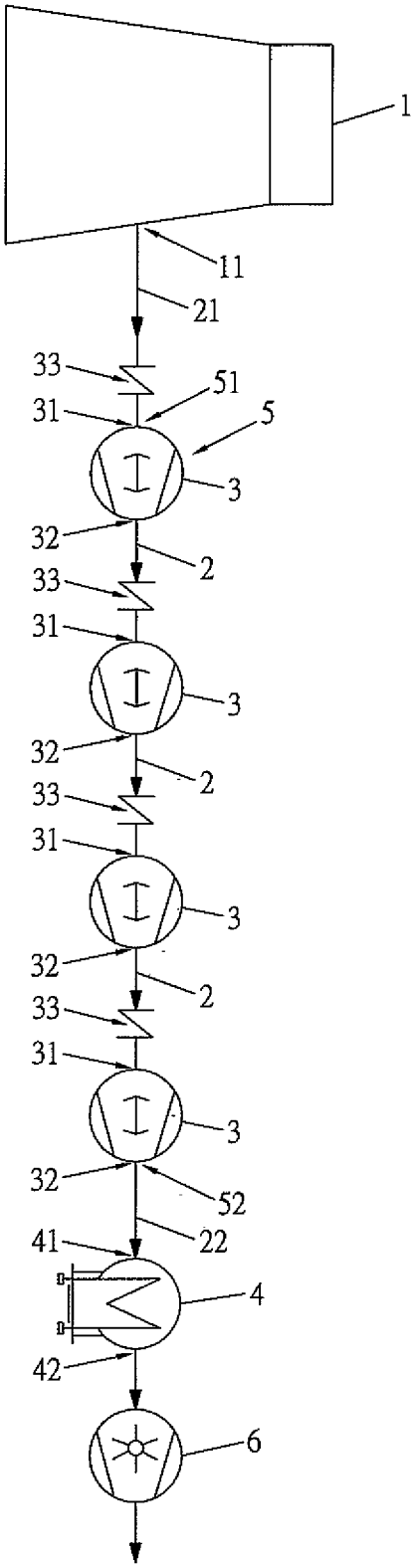
FIG. 2 is a schematic view showing the serial connection of a plurality of booster pumps according to the present invention.

With reference to FIG. 1, the at least one booster pump 3 may be only one booster pump 3, or the air draining end 11 booster pump 3 may be a plurality of booster pumps 3 which are connected in series or in parallel. With reference to FIG. 2, it is illustrated that the plurality of booster pumps 3 are connected in series for increasing pressures. A transfer pipe 2 serves to connected the two adjacent booster pumps 3 and is arranged between an air inlet 31 of a booster pump 3 and an air outlet 32 of another booster pump 3 so that the pressure increment or pressure decrement of the booster pump system 5 are distributed between the plurality of booster pumps 3 so that heat for compressing the air is distributed between the plurality of booster pumps 3 and thus the whole system may be operated steadily and is not destroyed due to overheating.

Figure 5:
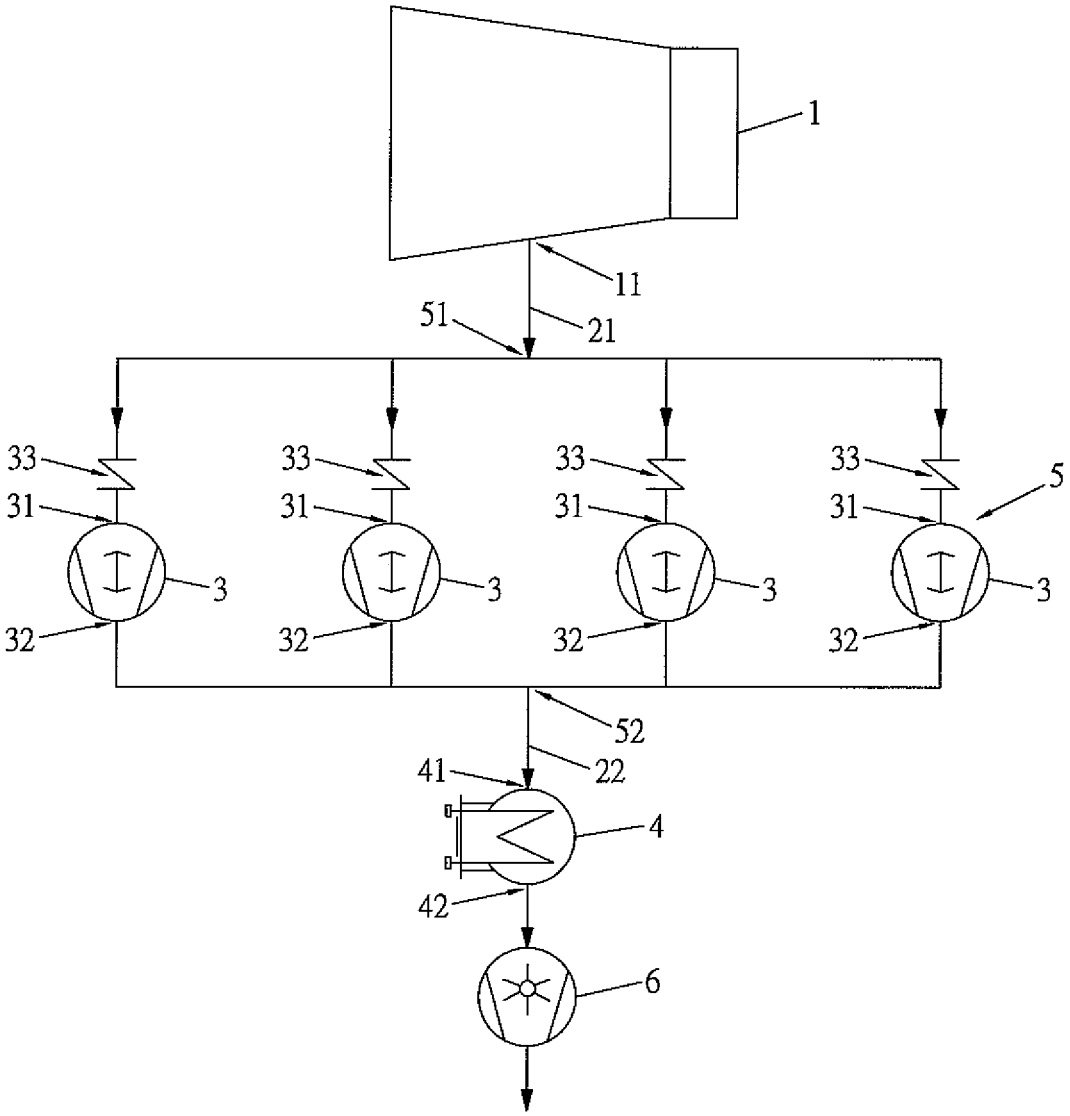
FIG. 5 is a schematic view showing the parallel connection of a plurality of booster pumps according to the present invention.

Referring to FIG. 5, it is illustrated that a plurality of booster pumps 3 are connected in parallel. The air inlets 31 of all the booster pumps 3 are connected to the input tube 21. The air outlets 32 of all the booster pumps 3 are connected to the output tube 22 so as to increase the pumping amount of gas of the booster pump system 5.

Figure 8:
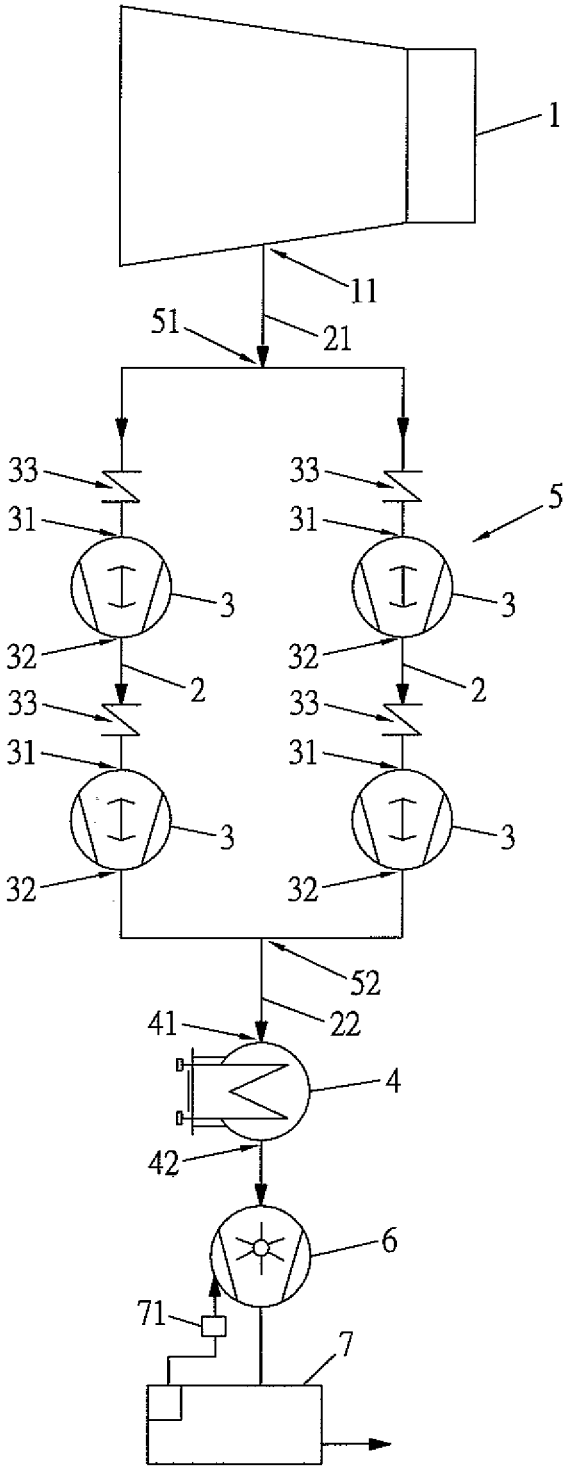
FIG. 8 is a schematic view showing the parallel connection of a plurality of booster pumps according to the present invention, where the booster pumps are formed as several booster pump sets.

With reference to FIG. 8, the plurality of booster pumps 3 may be formed as several booster pump sets which are connected in parallel. In each booster pump set, the air inlet 31 of one booster pump 3 is connected to an air outlet 32 of another booster pump 3 through a transfer pipe 2. The output tubes 22 are connected to the air outlets 32 of each booster pump set so that the waste gas can be drained with an optimum amount.

A condenser 4 has an input end 41. The output end 52 of the booster pump system 5 is connected to the input end 41 of the condenser 4 through the output tube 22. The condenser 4 serves to receive the waste gas (containing air and vapor) from the booster pump system 5 and cool the waste vapor as water. The condenser 4 may be water cooled condensers, air cooled condensers, or other kinds of condensers.

The present invention further includes a vacuuming system 6. An output end of the condenser 4 is connected to the vacuuming system 6 which is used to vacuum the non-condensed gas in the condenser 4 so that internal of the condenser 4 is vacuumed.

Figure 3:
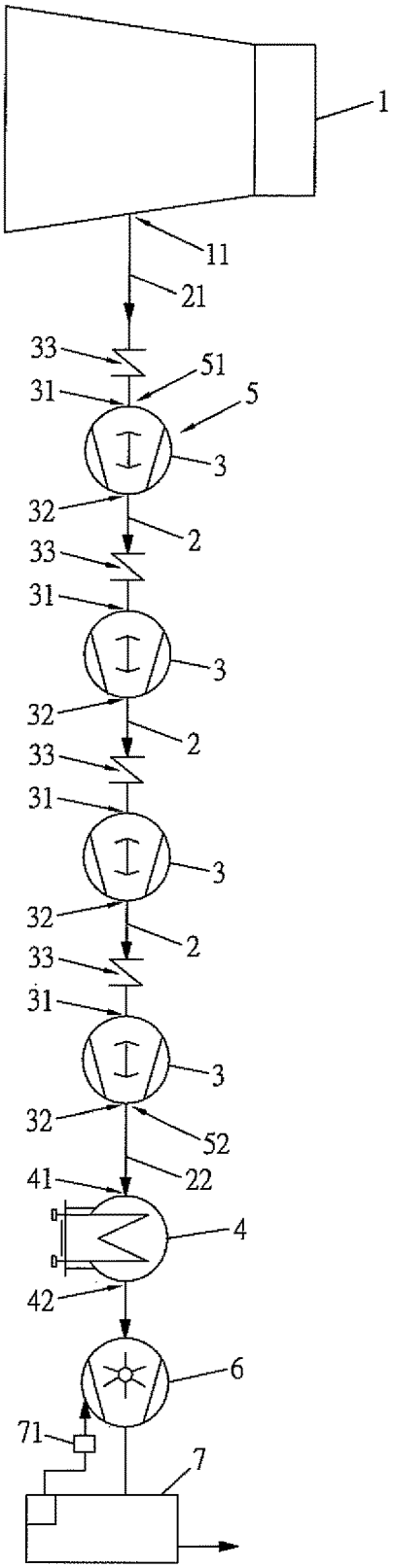
FIG. 3 is a schematic view showing the serial connection of a plurality of booster pumps according to the present invention, which the booster pump system is connected to a gas-vapor separator.
Figure 6:
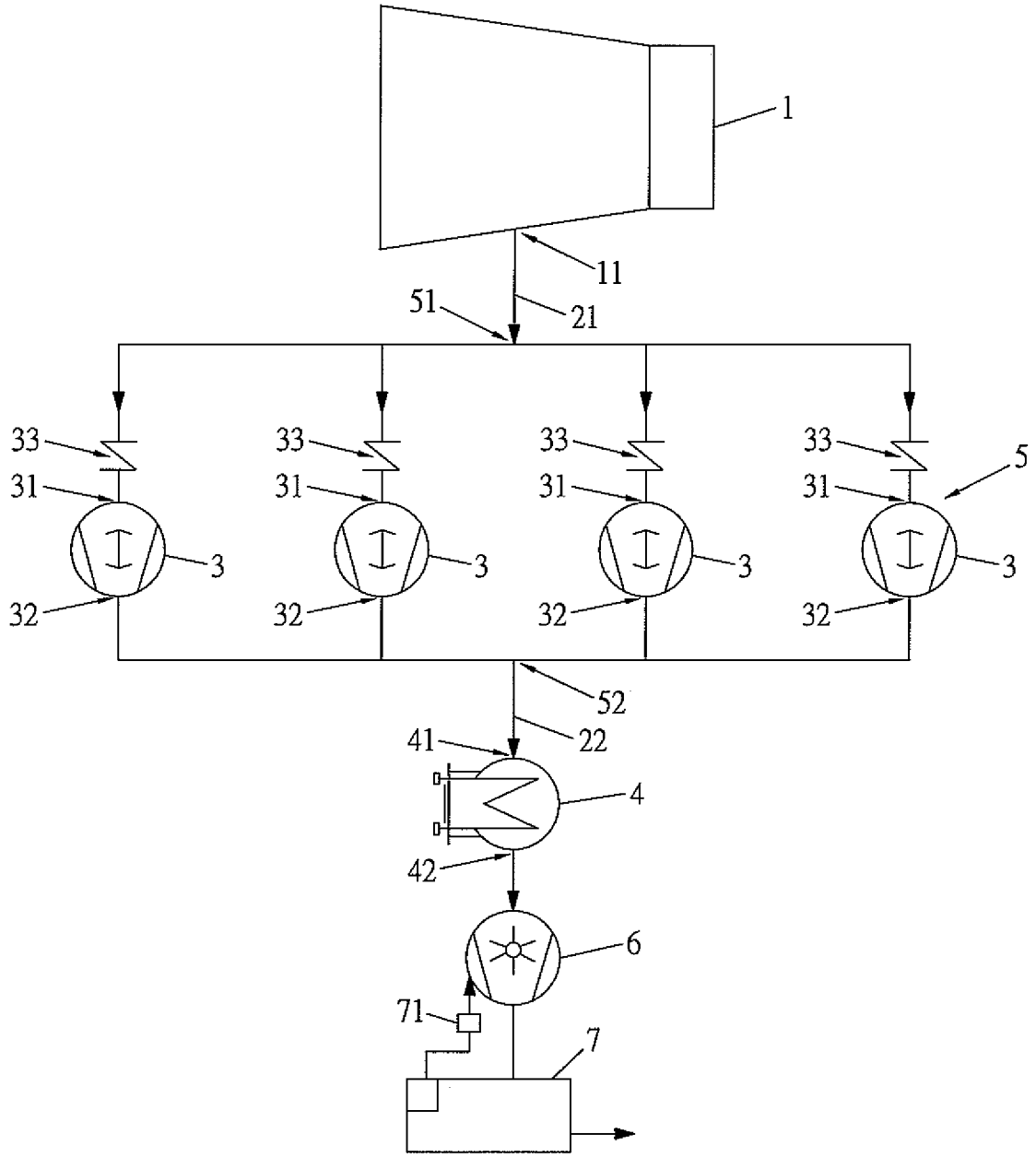
FIG. 6 is a schematic view showing the parallel connection of a plurality of booster pumps according to the present invention, where the booster pump system is connected to a gas-vapor separator.

With reference to FIGS. 3 and 6, the present invention further includes a gas-vapor separator 7 which is connected to the vacuuming system 6. The gas and water mixture from the vacuuming system 6 is inputted to the gas-vapor separator 7 and is then separated as air and liquid water. The liquid water is inputted to the gas-vapor separator 7 and then the liquid water passes through a loop heat exchanger 7 so that the water temperature of the water is adjusted to a proper temperature and then is returned to the vacuuming system 6.

Figure 4:
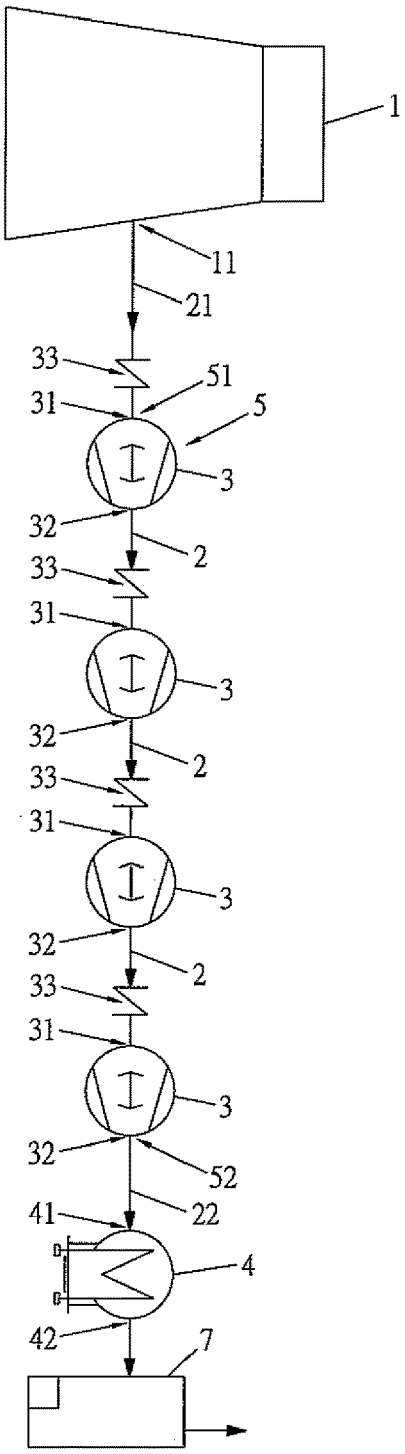
FIG. 4 is a schematic view showing the serial connection of a plurality of booster pumps according to the present invention, where the condenser is connected to a gas-vapor separator.
Figure 7:
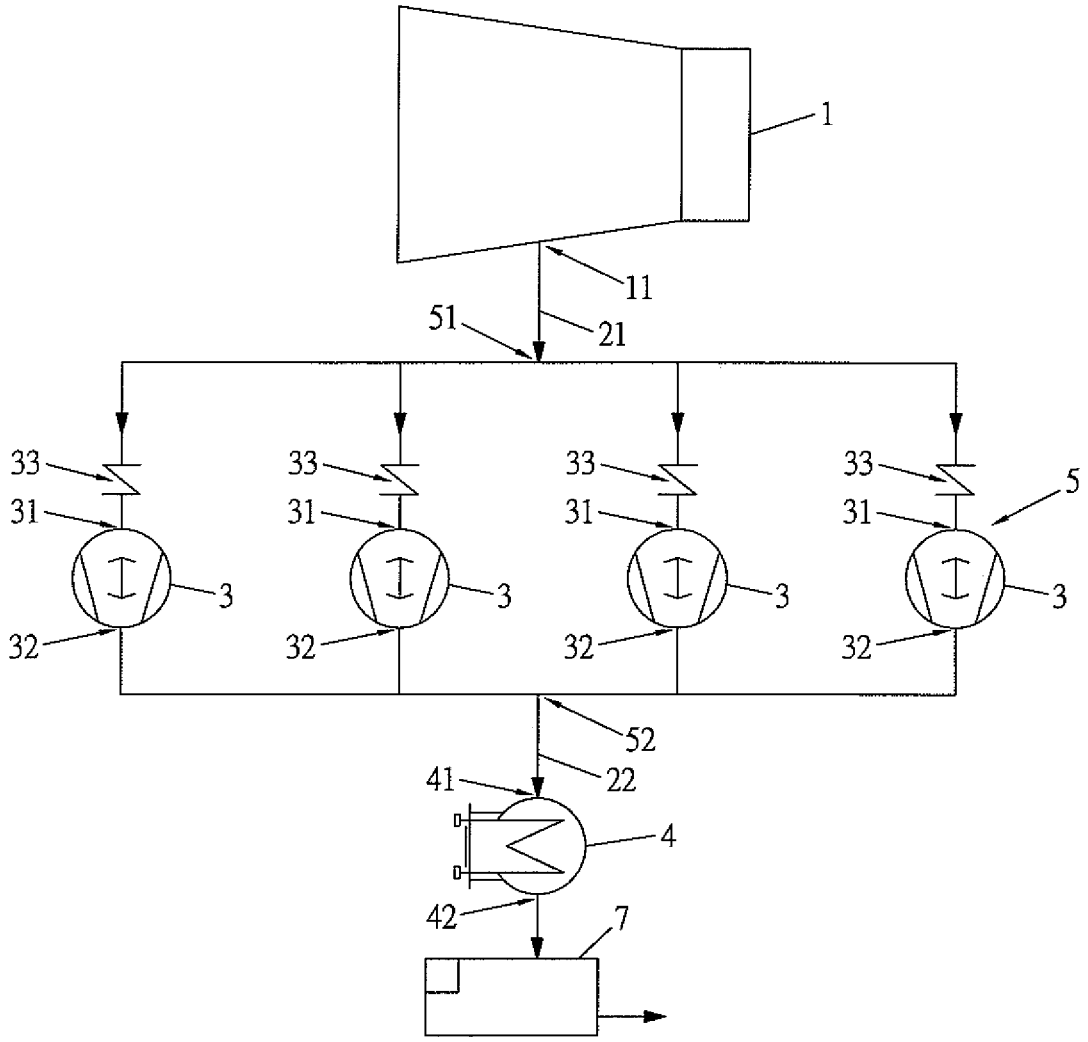
FIG. 7 is a schematic view showing the parallel connection of a plurality of booster pumps according to the present invention, where the condenser is connected to a gas-vapor separator.

With reference to FIGS. 4 and 7, in the present invention, the booster pump 3 may be neglected, while the gas-vapor separator 7 is directly connected to the output end 42 of the condenser 4. The gas and water mixture outputted from the condenser 4 is separated as gas and water by the gas-vapor separator 7.

Each output end 31 of each booster pump 3 may be installed with a valve 33 for closing or opening the booster pump 3 as desired so that the booster pump 3 may be isolated from the booster pump system 5 for increasing the reliability and operation ability of the booster pump system 5.

In the present invention, each booster pump 3 is formed with a channel (not shown). Therefore, when one booster pump 3 is stopped, the wasted gas may pass through the stopped booster pump 3 so that the turbine 1 can still be operated. The whole system can be operated safely.

Figure 9:
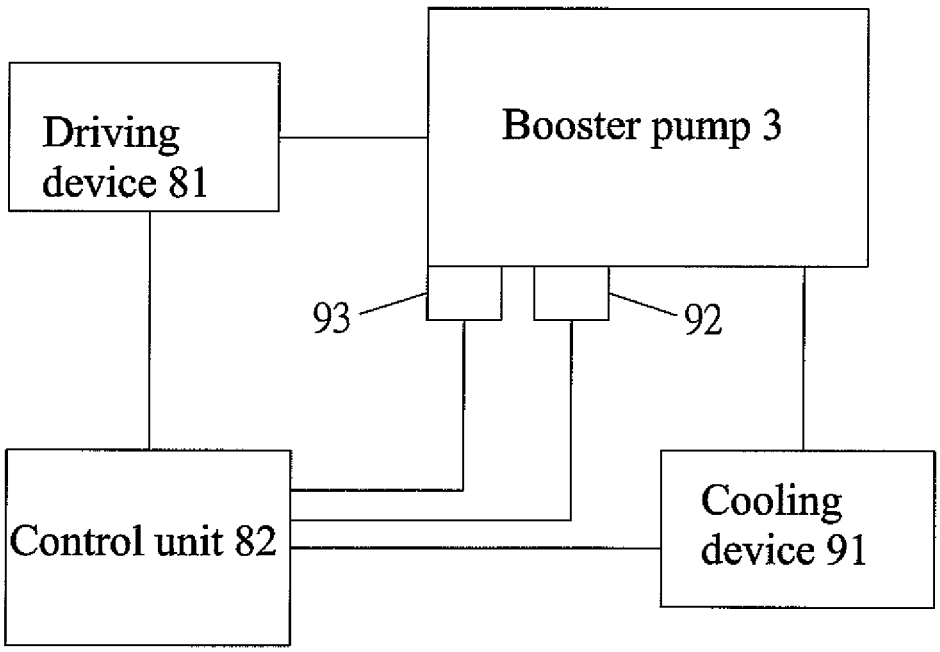
FIG. 9 is an element block diagram which shows the booster pumps, related electric elements and detection sensors according to the present invention.

A function block diagram of the booster pump 3 is shown in FIG. 9, which serves to display related electric and electronic elements and related detection elements.

The booster pump 3 is connected to a driving device 81. The driving device 81 is connected to a control unit 82. The control unit 82 serves to control the driving device 81 to control the booster pump 3. The control unit 82 controls the driving device 81 by adjustment of frequency so as to adjust the ability of each booster pump 3. The variation of frequency could assure that the booster pumps 3 can be operated safely. Low frequency operation can save power greatly and high frequency operation could present the pressure enhancement ability of the booster pump 3. Therefore, the speed of the booster pump system 5 is controlled so that the system has a preferred vacuum and is not affected by climates.

Each booster pump 3 is connected to a cooling device 91 which serves to input cooling water into the booster pump 3 for cooling.

Each booster pump 3 is arranged with a pressure sensor 92 and a temperature sensor 93. The pressure sensor 92 serves to detect the pressure of the pipes in the booster pump 3. The temperature sensor 93 serves to detect temperatures of the booster pump 3. The detected pressures and temperatures are transferred to the control unit 82 for controlling the driving device 81 and the control unit 82 so as to cause the booster pumps 3 to be operated steadily.

In the present invention, the booster pump system 5 may be fixed by fixing frames (not shown). The detailed is known in the prior art and thus the details will be further described herein.

Advantages of the present invention are that the booster pump system are added between the turbine and the condenser. The booster pump system serves to pump wasted gas in the turbine so that the drainage of the gas is enforced instead of naturally draining. The waste gas in the turbine is drained with a high efficiency so that power generation of the power system is promoted. Furthermore the coal consumption of the turbine is recued. As a result the power generation of a power plant is not affected by the environmental temperature, destroy of vacuum, and sizes of vacuum pumps. The power generator may be operated in an optimum state. In the present invention, the booster pumps may be connected serially or in parallel as desired so as to have an optimum removing of the waste gas from the turbine.

In the prior art, the condenser is installed with mechanical pumps or vapor pumps for increasing vacuum of the condenser, but in the present invention, the booster pump system is installed between the turbine and the condenser, which has the advantages that the condenser is not affected by the temperature of cooling water and drainage of water so that the power generation efficiency is not affected by the climates.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pre-booster pumping system for increasing power generation of a turbine of a thermal power plant, wherein the turbine has an air draining end; as pressured vapor passes through and driving the turbine, the vapor will lose of dynamics so as to form as waste gas containing air and vapor which is drained through the air draining end; the pre-booster pumping system comprising:

a booster pump system including an inlet end, an output end and at least one booster pump between the inlet end and the output end; the inlet end of the booster pump system being connected to the air draining end of the turbine through an input tube; each booster pump including an air inlet and an air outlet; the waste gas drained from the air draining end of the turbine being inputted to the booster pump from the inlet end of the booster pump; the vapor pressure being increased in the booster pump and then the vapor being outputted from the output end; and a condenser having an input end; the output end of the booster pump system being connected to the input end of the condenser through the output tube; the condenser serving to receive the waste gas containing air and vapor from the booster pump system and cool the waste vapor as water.

2. The pre-booster pumping system for increasing power generation of a turbine of a thermal power plant as claimed in claim 1, wherein the at least one booster pump is only one booster pump.

3. The pre-booster pumping system for increasing power generation of a turbine of a thermal power plant as claimed in claim 1, wherein the at least one booster pump is a plurality of booster pumps which are connected in parallel.

4. The pre-booster pumping system for increasing power generation of a turbine of a thermal power plant as claimed in claim 1, wherein the plurality of booster pumps are connected in series for increasing pressures; and a transfer pipe serves to connect two adjacent booster pumps and is arranged between an air inlet of a booster pump and an air outlet of another booster pump.

5. The pre-booster pumping system for increasing power generation of a turbine of a thermal power plant as claimed in claim 1, wherein the booster pump is an air pump which serves to increase air transfer speed.

6. The pre-booster pumping system for increasing power generation of a turbine of a thermal power plant as claimed in claim 1, wherein the booster pump is one of root pumps, centrifugal pumps, jet pumps or air pumps which can pump a large amount of air and can increase air transfer speed therein.

7. The pre-booster pumping system for increasing power generation of a turbine of a thermal power plant as claimed in claim 1, wherein each output end of each booster pump is installed with a valve for closing or opening the booster pump so that the booster pump may be isolated from the booster pump system.

8. The pre-booster pumping system for increasing power generation of a turbine of a thermal power plant as claimed in claim 1, wherein the condenser is one of water cooled condensers, and air cooled condensers.

9. The pre-booster pumping system for increasing power generation of a turbine of a thermal power plant as claimed in claim 1, further comprising a vacuuming system; an output end of the condenser being connected to the vacuuming system which is used to vacuum the non-condensed gas in the condenser so that interior of the condenser is vacuumed.

10. The pre-booster pumping system for increasing power generation of a turbine of a thermal power plant as claimed in claim 9, wherein further comprising a gas-vapor separator which is connected to the vacuuming system; the gas and water mixture from the vacuuming system is inputted to the gas-vapor separator and is then separated as air and liquid water.

11. The pre-booster pumping system for increasing power generation of a turbine of a thermal power plant as claimed in claim 1, further comprising a gas-vapor separator which is connected to the vacuuming system; the gas and water mixture from the vacuuming system is inputted to the gas-vapor separator and is then separated as air and liquid water.

12. The pre-booster pumping system for increasing power generation of a turbine of a thermal power plant as claimed in claim 1, wherein the booster pump is connected to a driving device; the driving device is connected to a control unit; the control unit serves to control the driving device to control the booster pump; and each of the booster pump is between a cooling device for cooling water into the booster pump and the driving device.

13. The pre-booster pumping system for increasing power generation of a turbine of a thermal power plant as claimed in claim 12, wherein the control unit controls the driving device by adjustment of frequency so as to adjust the ability of each booster pump.

14. The pre-booster pumping system for increasing power generation of a turbine of a thermal power plant as claimed in claim 12, wherein the each of the booster pump is arranged with a pressure sensor and a temperature sensor; the pressure sensor serves to detect pressures of pipes in the each of the booster pump; the temperature sensor serves to detect temperatures of the each of the booster pump; and the detected pressures and temperatures are transferred to the control unit for controlling the driving device and the control unit so as to cause the each of the booster pumps to be operated steadily.

* * * * *